US007464844B2

(12) United States Patent
Kamins et al.

(10) Patent No.: US 7,464,844 B2
(45) Date of Patent: Dec. 16, 2008

(54) STAPLER DEVICE AND METHOD

(75) Inventors: Michael Kamins, Grayslake, IL (US); Melvin Furusho, Wauconda, IL (US)

(73) Assignee: FPC Corporation, Wauconda, IL (US)

( * ) Notice: Subject to any disclaimer, the term of this patent is extended or adjusted under 35 U.S.C. 154(b) by 46 days.

(21) Appl. No.: 11/414,856

(22) Filed: May 1, 2006

(65) Prior Publication Data

US 2007/0257080 A1 Nov. 8, 2007

(51) Int. Cl.
*B25C 5/10* (2006.01)

(52) U.S. Cl. ..... 227/132; 227/120; 227/125; 227/126; 227/156

(58) Field of Classification Search ..... 227/120, 227/132, 125, 126, 156
See application file for complete search history.

(56) References Cited

U.S. PATENT DOCUMENTS 1,845,617 A * 2/1932 Metcalf ..... 227/96
2,746,044 A * 5/1956 Cusumano et al. ..... 227/132
3,199,185 A * 8/1965 Lash ..... 29/434
3,275,212 A * 9/1966 Johnson ..... 227/132
3,758,016 A * 9/1973 Olney et al. ..... 227/132
3,958,738 A 5/1976 Tremblay
5,335,839 A * 8/1994 Fealey ..... 227/132
6,145,728 A 11/2000 Marks
6,918,525 B2 7/2005 Marks

* cited by examiner

*Primary Examiner*—Rinaldi I. Rada
*Assistant Examiner*—Michelle Lopez
(74) *Attorney, Agent, or Firm*—Ryndak & Suri LLP

(57) ABSTRACT

A stapler device and a method of stapling an article. The stapler has a striker and a spring for driving the striker to apply a staple. During the stapling cycle, the striker and spring are cocked and loaded prior to being release to apply the staple. While the stapler is in the cocked and loaded position the stapling cycle is automatically interrupted to maintain the spring and the striker in the cocked and loaded position. The stapler device may be then moved to a second location before the interruption is discontinued by an actuator. Once the stapling cycle is continued, the cocked and loaded striker and spring are released to apply a staple. The device is also selectively capable of a second mode of operation wherein the stapling cycle is not interrupted.

14 Claims, 17 Drawing Sheets

STAPLER DEVICE AND METHOD

FIELD OF THE INVENTION

The present invention relates to a device and method for stapling. More particularly the present invention relates to improvements to a staple gun.

BACKGROUND OF THE INVENTION

Conventional spring powered staple guns may be used to staple one or more articles to a surface. Typically, the article to be stapled is manually aligned and temporarily held in place against the surface it is to be stapled to. The staple gun is then positioned at the desired location for application of a staple. The handle of the staple gun is forced downward by the user to cause the staple gun to shoot a staple out of the gun. The staple is thereby forced through the article and into the surface to attach the article to the surface.

Conventional staple guns have certain drawbacks when used for a number of types of applications. One drawback results when using a staple gun to attach an article to a surface that is overhead or otherwise hard to reach. In such instances, the user is required to depress the handle against the considerable force of a spring to activate the stapler; and this must be done when the user's hand is at an awkward position or angle. When the user's hand is at an awkward position or angle, the user may be unable to generate enough force to activate the staple gun. Moreover, even if the user can generate the required force while in the awkward position, if a number of staples are required, fatigue may quickly be experienced.

A specific example where awkward stapling positions is encountered is the task of stapling insulation in place between overhead rafters. To accomplish the task, a large number of staples are needed to be applied at various angles which may be difficult for the user to depress the staple gun handle to activate the spring of the stapler. This is especially true in view of the fact that depression of the stapler handle needs to occur while the user is attempting to hold the insulation in place, and while simultaneously aligning the stapler with its intended target.

Other applications require precise alignment of the staple and the article with the surface it is to be stapled to. One example of such an application occurs in the stapling of upholstery fabric to a frame of a piece of furniture. The upholstery must be carefully aligned with the frame so as not to create wrinkles and bulges in the upholstery. The staples themselves may also need to be carefully aligned to provide a professional appearance for the finished product. Moreover, once aligned, care must be taken so that the alignment is not disturbed when the user applies the required force to activate the staple gun. Often in such applications, the user creates a torque during the depression of the handle, resulting in twisting the upholstery out of place as it is stapled. In such instance, the user must remove the staple, realign the upholstery, and repeat the stapling attempt.

Thus, a need exists for a stapler that can be used in applications conducted overhead or at difficult to reach locations. A need also exists for a stapler that can be activated by a person not strong enough to activate the stapler in normal use. A further need exists for a staple gun for use when careful alignment of the stapled article, surface and staple is required.

SUMMARY OF THE INVENTION

In accordance with one aspect of the invention a staple gun having a housing and a striker is provided. The striker is moveable through a stapling cycle that includes a cocked position. A force providing mechanism is also movable through a force applying cycle that includes a cocked position. The force providing mechanism provides a force for expelling a staple from the housing to apply a staple. The stapler includes a cycle interrupter for providing an interruption in at least one of the stapling cycle and the force applying cycle. The interruption occurs when the stapling cycle is in the cocked position or when the force applying cycle is in the cocked position. An actuator mechanism releases the cycle interruption to thereby allow the cycle to continue to apply the staple.

In accordance with another aspect of the invention the actuator is manually actuated to cause the actuator mechanism to release cycle interrupter and thereby discontinue the interruption.

Typically, in one mode of operation, the stapler is cocked and loaded in a position that is convenient for the user, and then the staple gun can be moved to a second location that may be an awkward or difficult location to reach. The repositioned stapler is then fired when the user operates the actuator mechanism.

In accordance with another aspect of the invention the staple gun includes a mode selection control for selecting between a first and a second mode of operation. In the first mode of operation, the cycle interrupter is deactivated so that cycle interrupter does not interrupt a cycle. In the second mode of operation, the cycle is interrupted allowing the staple gun to be repositioned prior to firing to staple an article.

Typically, the staple gun is operated in the second mode of operation in instances requiring precise alignment of the article to be stapled with the surface it is to be stapled to. Another typical use is in instances where the staple is applied in positions that are awkward or hard to reach. In other instances the user may select the first mode of operation when it is desired that the stapling cycle not be interrupted.

In accordance with another aspect of the invention a stapler device having a housing, and a staple feed mechanism is provided. The striker is reciprocally moveable between at least a first position and a cocked position. The device includes at least a first spring that is moveable between at least a first position to a cocked position for storing energy in the spring. The spring is associated with the striker to cause rapid movement of the striker to apply a staple when the striker is released from the cocked position. A loading mechanism moves the striker from at least the first position to the cocked position. A striker movement inhibitor is moveable between a disengaged position allowing movement of the striker, and an engaged position restraining movement of the striker. The striker movement inhibitor is moveable from the disengaged position to the engaged position when the striker is in the cocked position to maintain the striker in the cocked position. An actuator mechanism disengages the striker movement inhibitor from the engaged position. When disengaged, the striker is allowed to move from the cocked position, and the first spring rapidly moves the striker to the first position to apply a staple.

In another aspect of the invention the stapler device includes a trigger. The trigger has a first position allowing the striker movement inhibitor to maintain the spring and the striker in the cocked position. The trigger is manually moveable to a second position for causing the striker movement inhibitor to move to the second position to release the spring and the striker from the cocked position.

In another aspect of the invention the striker movement inhibitor includes a latch. The latch has a first end and a second end, and the latch is movable between a first position and a second position. The first end of the latch engages the striker when the latch is in the first position to maintain the striker in the cocked position.

In another aspect of the invention a method of stapling is provided. The method includes providing an article to be stapled and providing a surface to staple the article to. A stapling device is loaded at a first location with a force for applying a staple. The stapling device is moved to a second location after loading the force. The stapler is positioned adjacent the article. Thereafter the loaded force is released to staple the article to the surface.

In another aspect of the invention the method includes forcing a spring to a loaded position and thereafter maintaining the spring in the loaded position for a period of time. The stapler device is moved to a second location before releasing the spring from the loaded position to force a staple from the stapler to staple an article to the surface.

Typically, the stapling method may be used to allow the stapler to be loaded with a force while the stapler device is held by the user at a convenient position, such as at belt height or when placed on a surface to gain leverage. The stapler can then be moved to a second location, such as an overhead or other awkward position before releasing the loaded force to apply a staple. The stapling method is also advantageous for use in applications where loading the stapler device when positioned against a precisely aligned article and surface, would cause the article to shift out of alignment. By loading the stapler at a remote location the alignment of the article is not disturbed.

DETAILED DESCRIPTION OF THE INVENTION

Figure 1:
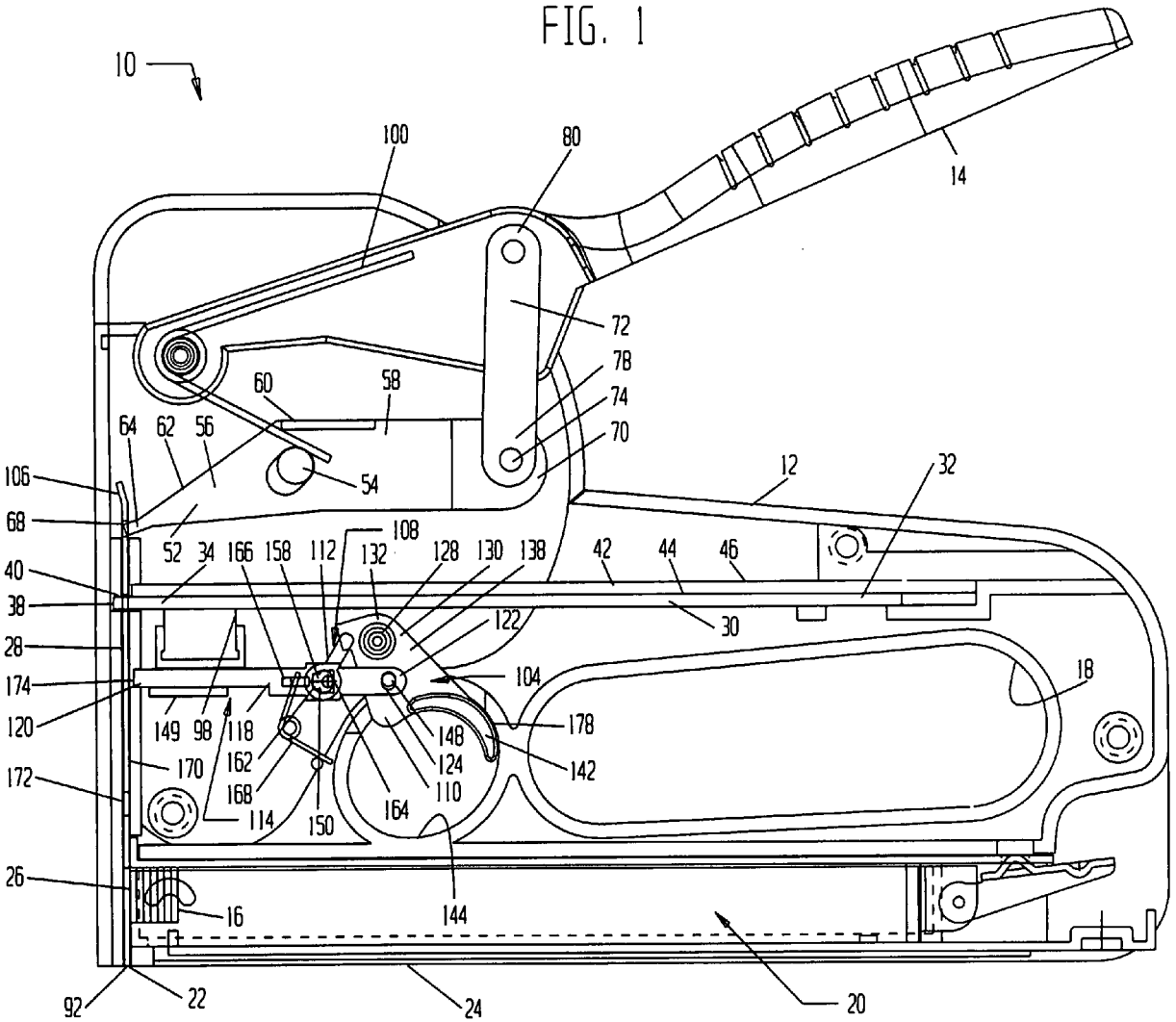
FIG. 1 is a side elevation of the stapler of the invention with the housing partially removed and with the stapler shown at the beginning of the stapling cycle.
Figure 12:
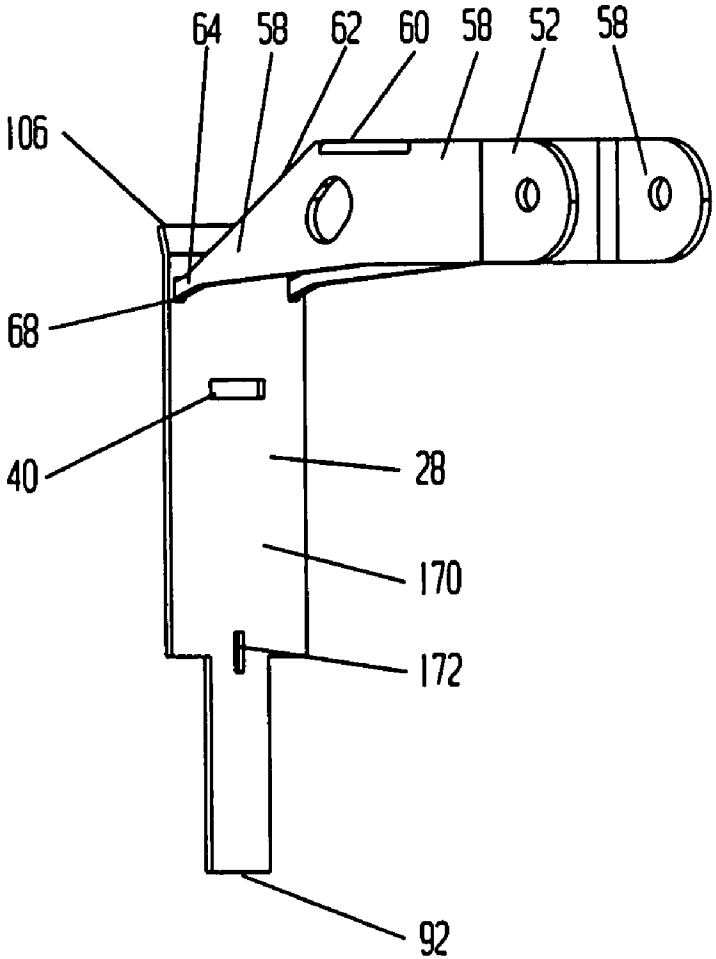
FIG. 12 is a perspective view of the striker engaged by the lifter.
Figure 13:
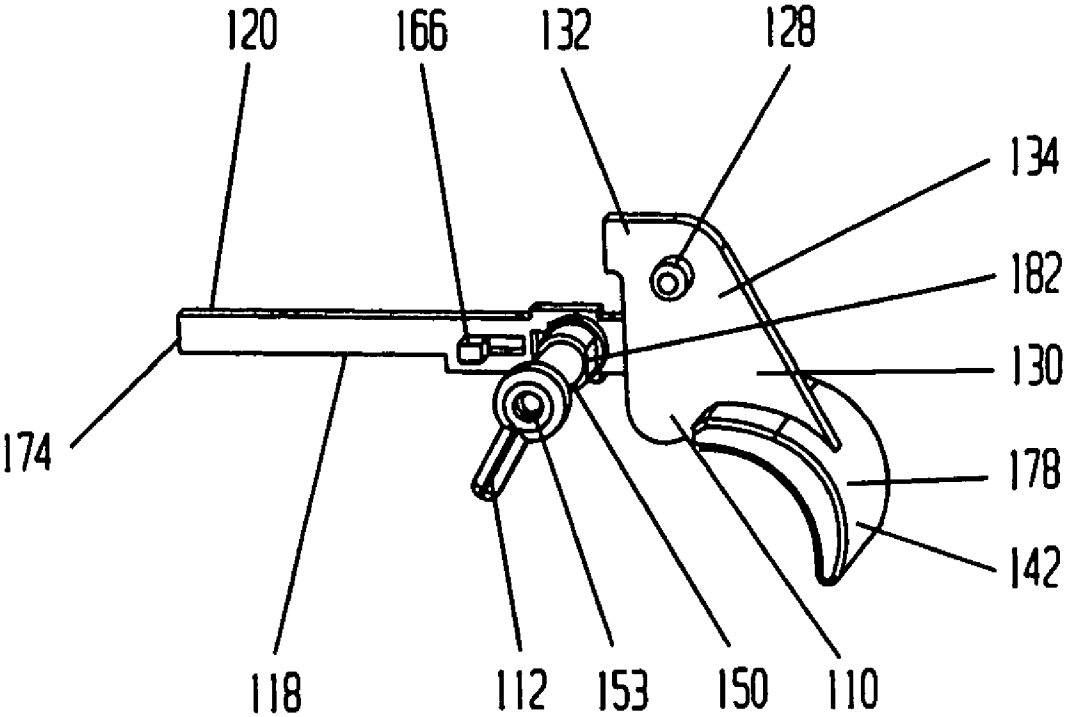
FIG. 13 is a perspective view of the latch, locking pin and trigger.

FIG. 1 shows a stapler device 10 that has a housing 12 with an attached handle 14 and a grip 18. Housing 12 may be of a multiple section construction, with the sections assembled together to form housing 12. Positioned adjacent the bottom 24 of housing 12 is a staple feed mechanism 20, for advancing the staples 16 stored on a staple magazine toward an opening 22 in the housing bottom 24. A striker 28, shown also in FIG. 12, is slideably mounted within housing 12 for reciprocal upward and downward movement. In the operation of stapler device 10, striker 28 sequentially and forcefully moves the lead staple 26 of the magazine downward. Lead staple 26 is expelled out opening 22 to drive staple 26 through an article and into an adjacent surface.

A spring 30, for applying a stapling force to striker 28, has a rear end 32, and a front end 34 with a front tip 38 extending therefrom. Spring 30 is mounted within housing 12 with a generally perpendicular orientation to striker 28, when spring 30 is in the un-flexed or unloaded position. The front tip 38 of spring 30 extends through an opening 40 in striker 28 to secure spring 30 within striker 28. Rear end 32 of spring 30 extends over hand grip 18. An optional shorter spring 42, for increasing the actuation force applied to striker 28, is positioned on the top surface 44 of spring 30. Also, a tension adjustment bar (not shown) may be provided to adjust the tension of springs 30, 42. The tension adjustment bar may be slideable along the top surface 46 of spring 42 to change the fulcrum point to thereby adjust the tension of springs 30, 42.

Figure 2:
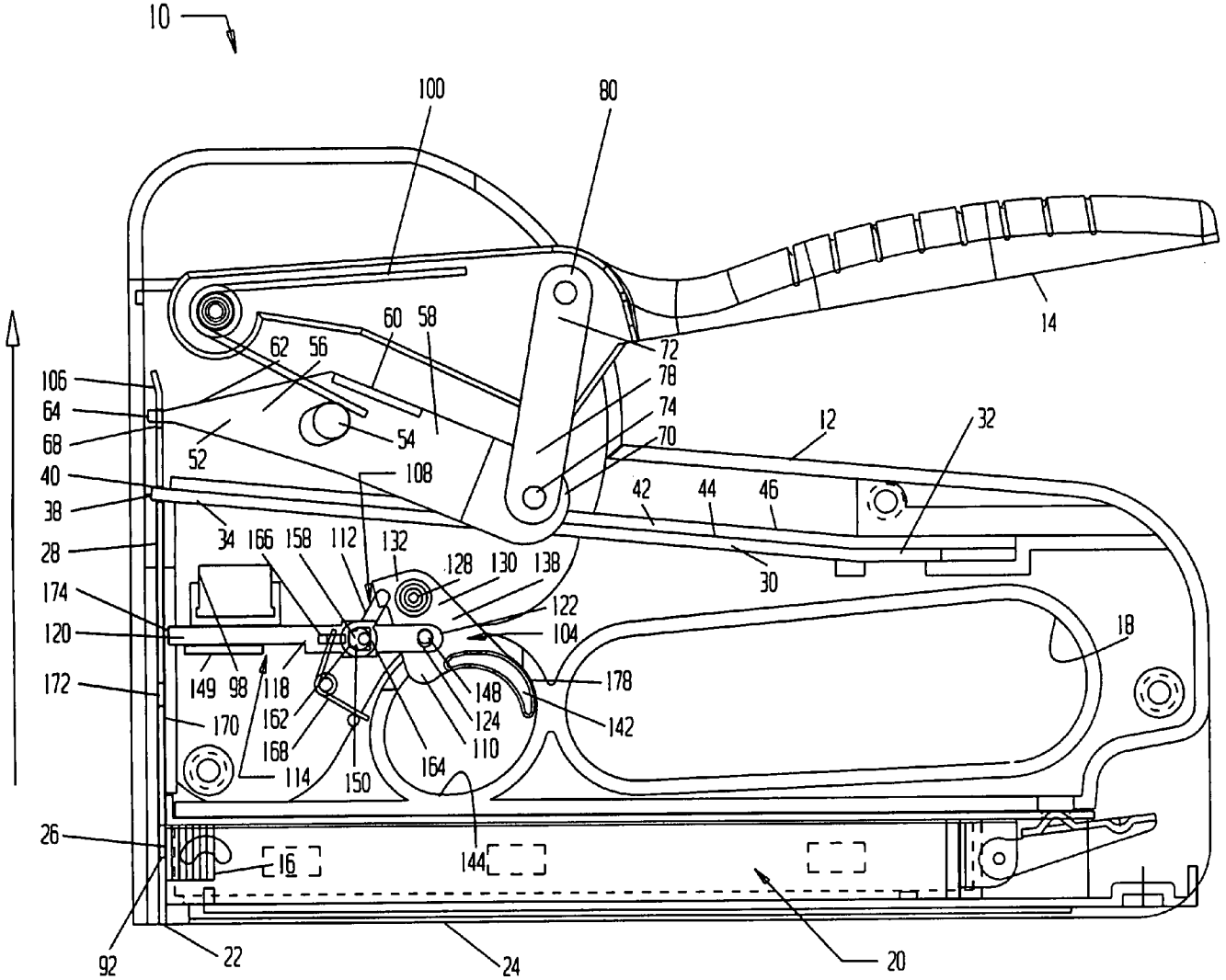
FIG. 2 is a side elevation of the stapler approximately at the midpoint of energizing the stapler.

A lifter 52, for lifting striker 28 while placing springs 30, 42 in tension, is pivotably mounted at a pivot pin 54 secured to housing 12. Lifter 52 has sides 58 that are joined together by a brace 60. The front end 56 of each of sides 58 has a taper 62 leading to a front tip section 64. As shown in FIG. 1, each of tip sections 64 extend into lifter openings 68 in striker 28. The rear end 70 of lifter sides 58 has a link 72 attached thereto, by a rivet 74, for example, at the bottom end 78 of link 72. The top end 80 of link 72 is connected to handle 14. Thus, as shown in FIG. 2, the downward movement of handle 14 acts as a lever to force the bottom end 78 of each link 72 downward. This causes the downward movement of lifter rear end 70. At the same time lifter 52 pivots about pin 54 to raise front tip sections 64 upward. The upward movement of front tip sections 64 also raises striker 28. As striker 28 is raised upward, striker 28 carries spring 30 upward, since spring tip 38 extends through striker opening 40.

After striker 28 has been raised above lead staple 26, lead staple 26 is advanced forward by feed mechanism 20. Lead staple 26 is moved into the plane of the stroke of striker 28, and remains at that position until driven by striker 28 on its downward stroke, as described below in greater detail.

Figure 3:
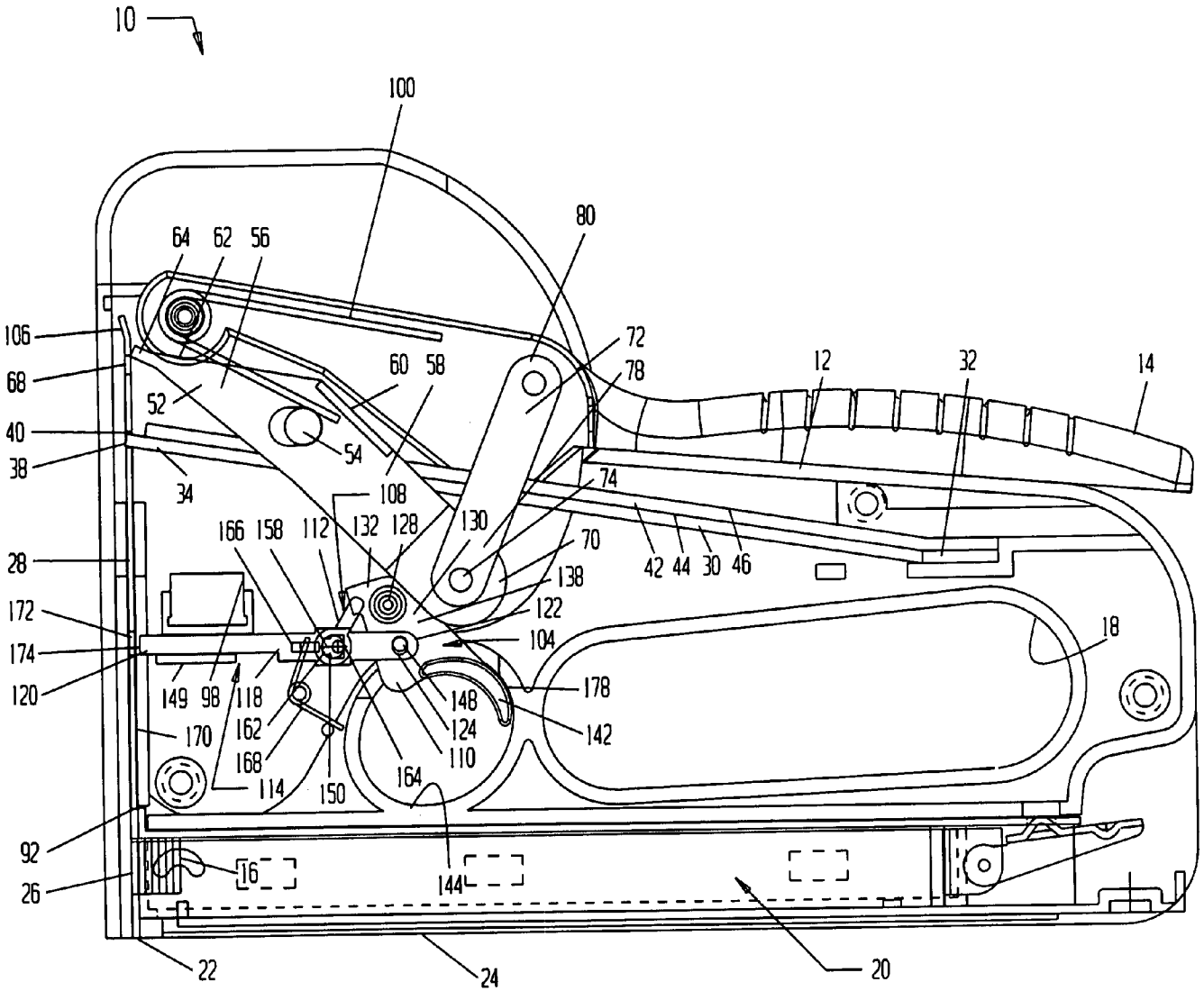
FIG. 3 is a side elevation of the stapler with the stapler fully energized.
Figure 4:
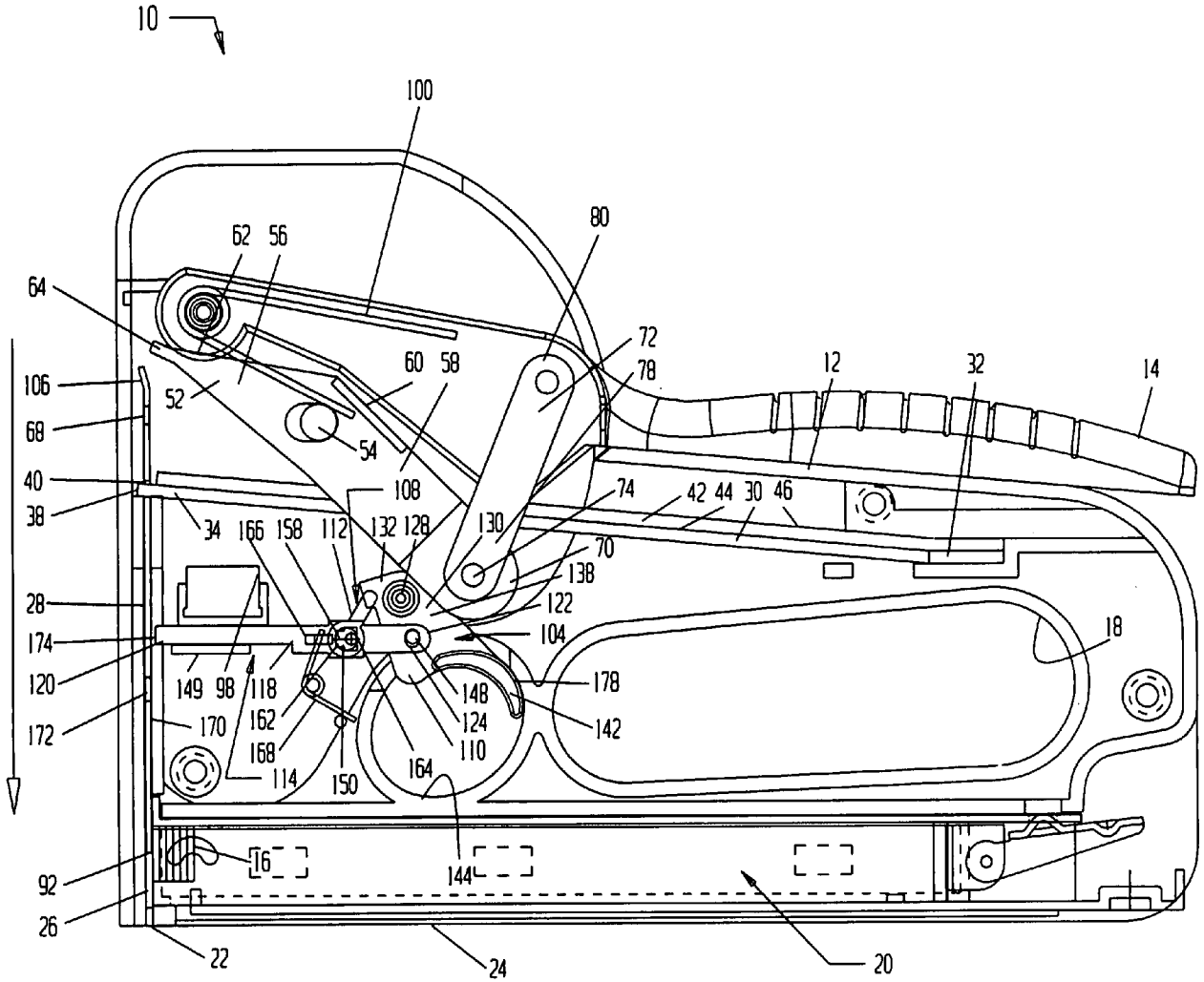
FIG. 4 is a side elevation of the stapler with the striker disengaged from the lifter and in its downward stroke.
Figure 5:
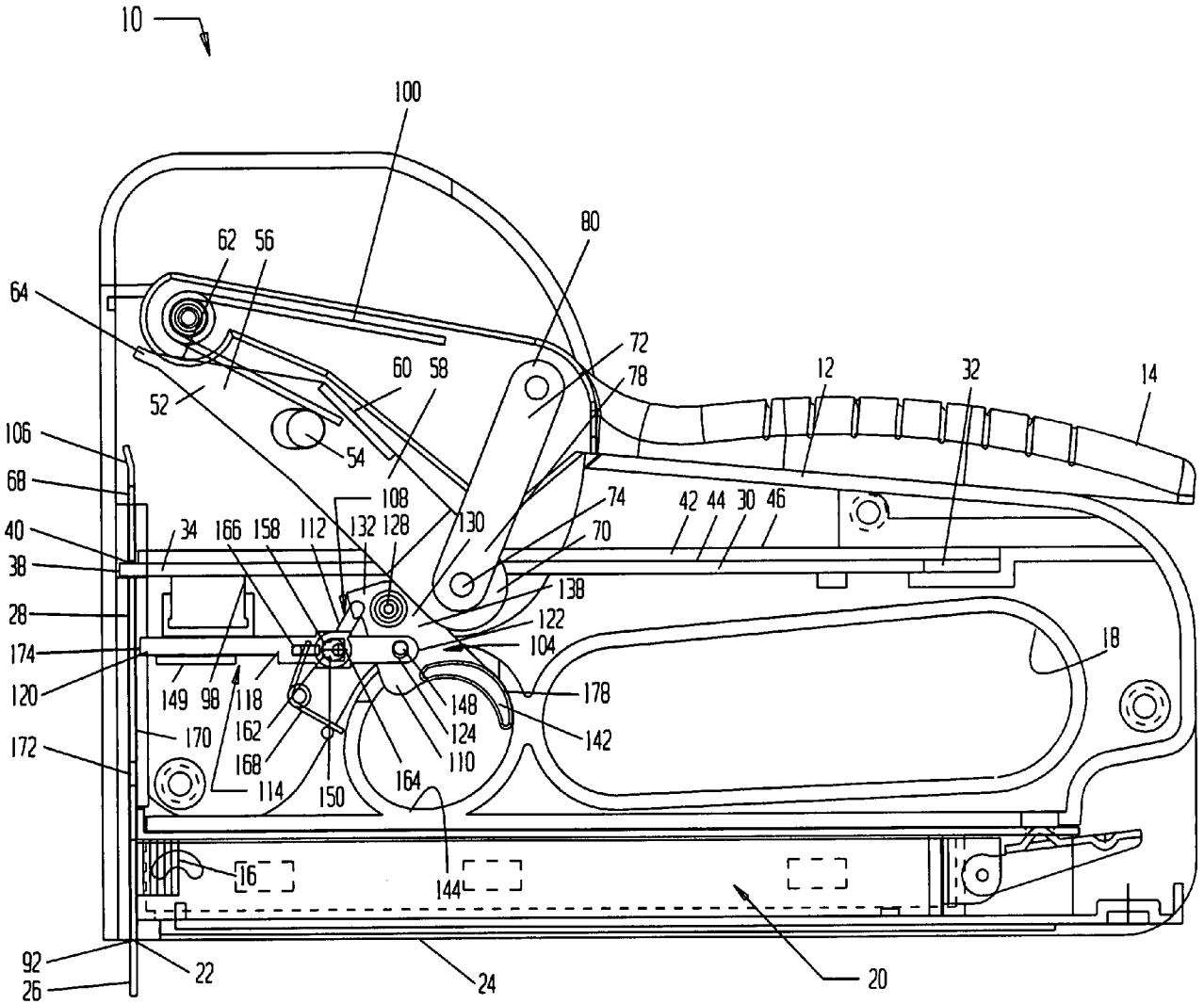
FIG. 5 is a side elevation of the stapler at the end of the stapling cycle and the striker at the end of its downward stroke.

Referring now to FIG. 3, as handle 14 is continued to be depressed downward, striker 28 continues its upward movement. At the top of the upward stroke of striker 28, lifter 52 has pivoted to a point where front tips 64 have withdrawn from openings 68 in striker 28. At this point, springs 30, 42 are fully loaded and striker 28 is free from engagement with lifter 28. Once disengaged, as shown in FIG. 4, the stored energy of springs 30, 42 rapidly forces striker 28 downward. Bottom leading end 92 of striker 28 travels downward to strike the lead staple 26 of the staple magazine. As shown in FIG. 5, striker 28 continues its downward stroke, driving lead staple 26 out staple exit opening 22. Striker 28 also drives lead staple 26 through the article being stapled and into the surface to which the article is being stapled to. At the end of the downward stroke of striker 28, spring 30 comes to rest against a shock absorber 98 that is secured to housing 12.

After the stapling has been completed, the user releases the grip on handle 14. A handle spring 100 then returns handle 14 to the fully upward position as shown in FIG. 1. As handle 14 is returned to the upward position, lifter tip sections 64 are returned downward. A forward curved flange 106 on the top end of striker 28 directs lifter tip sections 64 to slide again in place within striker openings 68. Striker 28 and springs 30, 42 remain in the resting position shown in FIG. 1 until the stapling cycle described above is to be repeated.

The foregoing description of the operation of stapler device 10 illustrates a first mode of operation. Stapler device 10 is also selectively capable of a second mode of operation. In the second mode of operation, stapler device 10 is capable of locking striker 28 and springs 30, 42 in a cocked, or loaded position to thereby interrupt the stapling cycle. Thereafter, the cocked and force loaded stapler 10 can be repositioned prior to initiating the downward discharge stroke of striker 28. Thus, stapler 10 may be cocked while stapler 10 is held by the user in a convenient position for applying a force to depress handle 14. Thereafter, stapler 10 can be moved to a remote position where the user can release the striker 28 to staple an article. The stapler is fired by an actuator mechanism 104. Actuator mechanism 104 may be a trigger 110, push button, or other mechanism.

The second mode of operation is selected by use of a mode selection control 108. Mode selection control 108 includes a trigger lock on-off lever 112. For the first mode of operation, lever 112 is in the off position as shown in FIGS. 1-5. In this mode, the stapling cycle is not interrupted and trigger 110 is not active. For the second mode of operation, lever 112 is in the on position as shown in FIGS. 6-11. In this second mode of operation, the stapling cycle is interrupted by a striker movement inhibitor 114, and stapler 10 is later fired by use of a trigger 110.

Striker movement inhibitor mechanism 114 includes a latch 118. Latch 118 has a front end 120 and a rear end 122 having a hole 124. Trigger 110 includes a flange 130 having an upper end 132. Proximate to upper end 132, trigger flange 130 has a pin 128 that extends outwardly of both sides 134, 138 of flange 130. The ends of pin 128 are positioned within bores (not shown) in housing 12 to pivotably mount trigger 110 to housing 12. A finger grip section 142 of trigger 110 depends downward of flange 130 and extends into a trigger opening 144 in housing 12.

Figure 14:
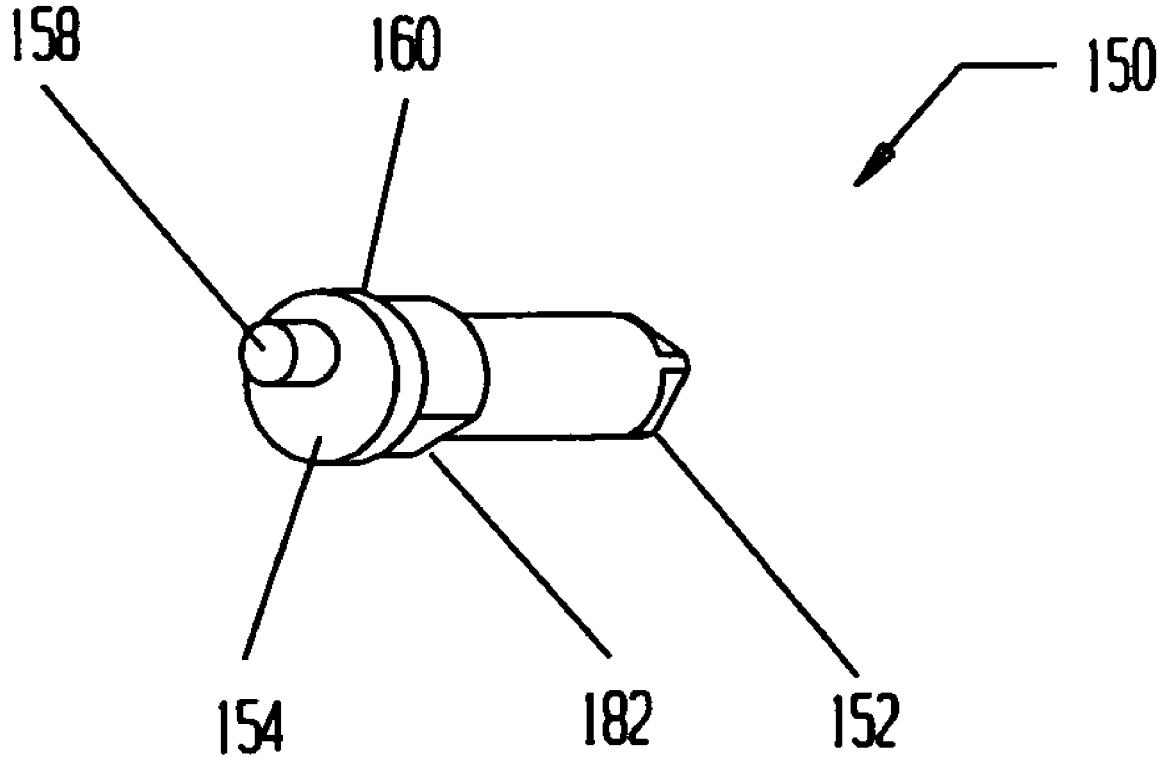
FIG. 14 is a perspective view of the locking pin.
Figure 16:
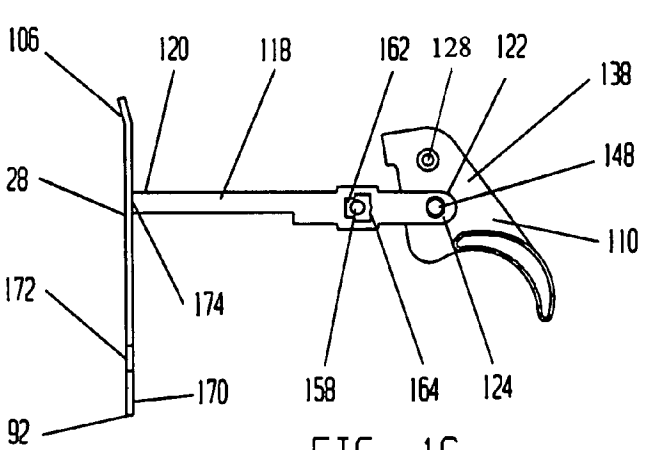
FIG. 16 is a side elevation showing the position of the latch and striker in the second mode of operation at the start of the stapling cycle.
Figure 15:
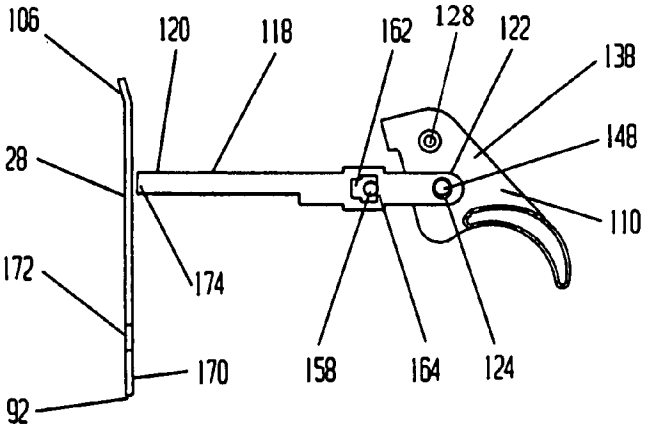
FIG. 15 is a side elevation showing the position of the latch and striker in the first mode of operation for the stapler.

Flange side 138 has a second pin 148 extending therefrom. The rear end 122 of latch 118 is connected to trigger flange 130 by inserting pin 148 into hole 124 of latch 118. Latch 118 is also slideably supported at a support 149 formed on housing 12. A multiple shaped locking pin 150, best seen in FIG. 14 for use in selecting the mode of operation of the stapler 10, has one end 152 secured to lever 112, such as by a screw 153. The other end 154 of locking pin 150 has an eccentric section 158 that is eccentric from an axially aligned cylindrical section 160. Eccentric section 158 is inserted in opening 162 of latch 118. As can be seen in FIG. 15, when trigger lever 112 is in the trigger off position, eccentric cylinder 158 abuts against the rear surface 164 of opening 162. This limits the forward movement of latch 118, and thus latch front end 122 is at all times spaced from striker 28. For the second mode of operation, lever 112 is rotated to the trigger-on position shown in FIGS. 6-11. As best seen in FIG. 16, rotation of lever 112 has moved eccentric section 158 from a position rearward of the axis of pin 150 to a position forward of the axis of locking pin 150. Thus, eccentric section 158 is rotated to a position closer to striker 28. This provides a clearance between rear surface 164 of opening 162 and eccentric section 158. Because of this clearance, latch 118 is free to move forward towards striker 28 under the biasing force of a latch spring 168. Latch 118 moves forward until the front tip 174 contacts the rear surface 170 of striker 28. At this point, it is noted that a small clearance still remains between rear surface 164 of latch opening 162 and eccentric section 158. This allows for a further advancement of latch 118 at a later time as described below. It is also noted that as trigger latch 118 moves forward, trigger 110 is rotated forward due to the connection between latch 118 and trigger 110 at pin 148.

A "U" shaped spring clip (not shown for clarity) is mounted to housing 12 to prevent unintended rotation of locking pin 150 once it is moved to the trigger on or to the trigger off position by lever 112. The "U" spring clip has flat sides that engage the flat surfaces 182 of locking pin 150 when locking pin 150 is in the on or in the off position. Thus, cylinder 150 may be locked in position against unintended rotation, unless the user rotates cylinder 150 by lever 112 to overcome the biasing force of the sides of the spring clip.

Figure 6:
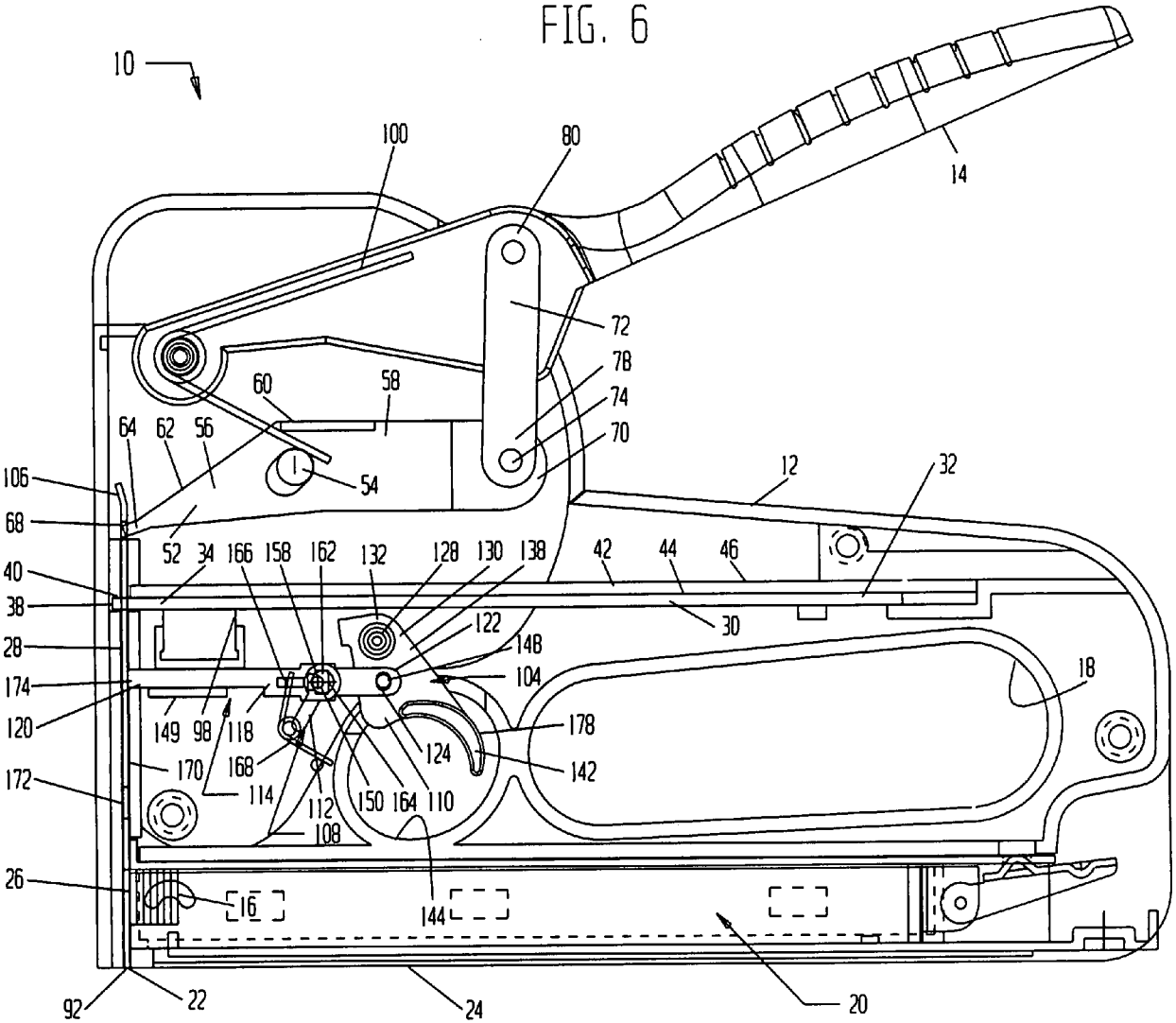
FIG. 6 is a side elevation of the stapler of the invention with the housing partially removed and with the stapler shown at the beginning of the stapling cycle while in a second mode of operation.

In a similar manner to the illustration of FIGS. 1-5 showing the operation of stapler 10 in the trigger off mode, FIGS. 6-11 illustrate the operation of the stapler 10 when in the trigger on mode. FIG. 6 shows that lever 112 has been rotated to the trigger on mode, and stapler 10 is ready to begin a stapling cycle in the second mode of operation. With the lever 112 in the trigger on position, eccentric cylinder section 158 is rotated forward, as previously described and more clearly shown in FIG. 16. Trigger latch front tip 174 is biased forward against the rear surface 170 of striker 28.

Figure 7:
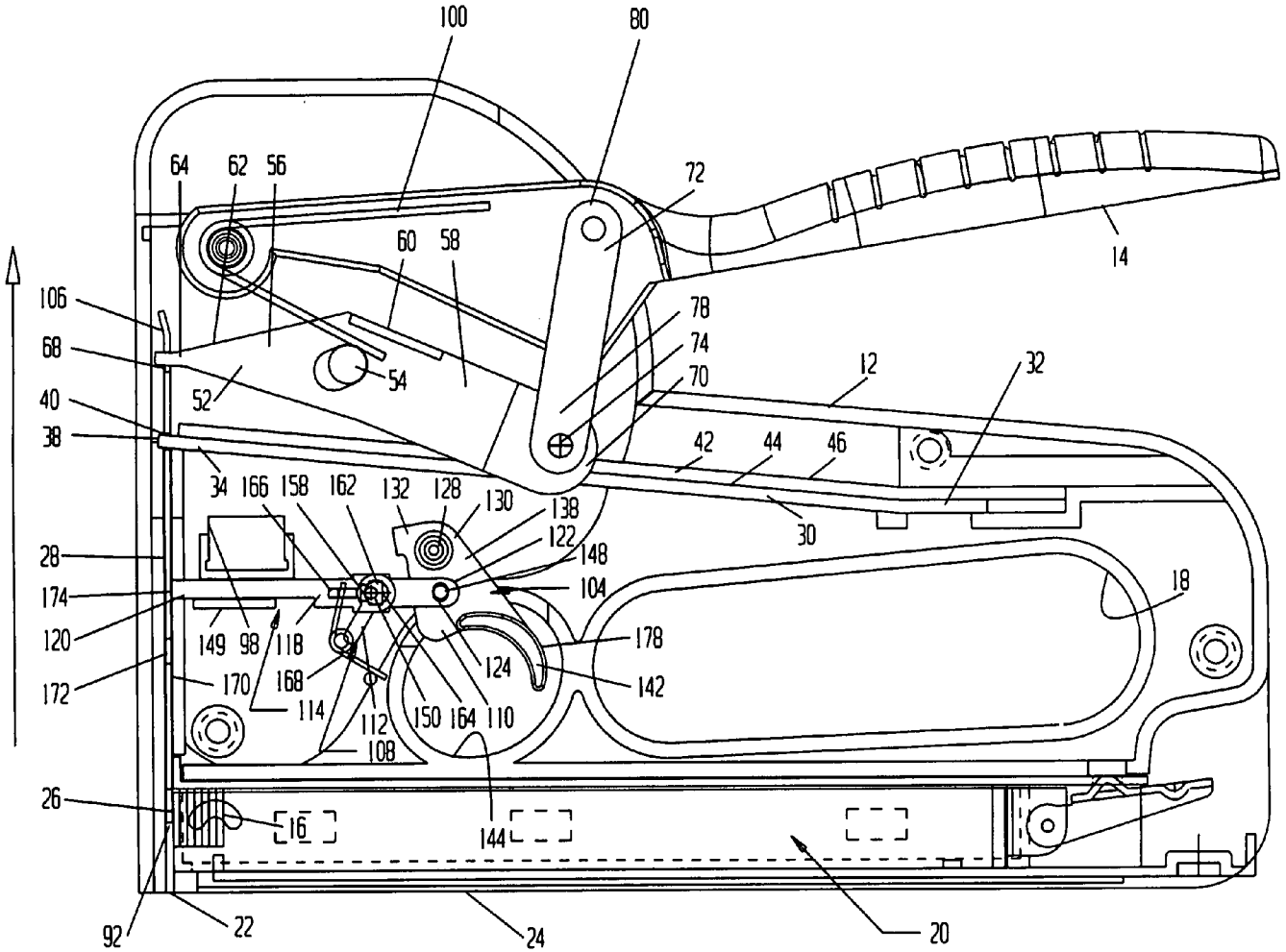
FIG. 7 is a side elevation of the stapler approximately at the midpoint of energizing the stapler while in the second mode of operation.

FIG. 7 shows handle 14 at the midpoint of the downward stroke of handle 14. In this position, it is noted that the front end 56 of lifter 52 has been pivoted upward, raising striker 28 upward. At the same time springs 30, 42 have been carried upward by striker 28. During the upward movement of striker 28, rear surface 170 of striker 28 slides along front tip 174 of latch 118.

Figure 8:
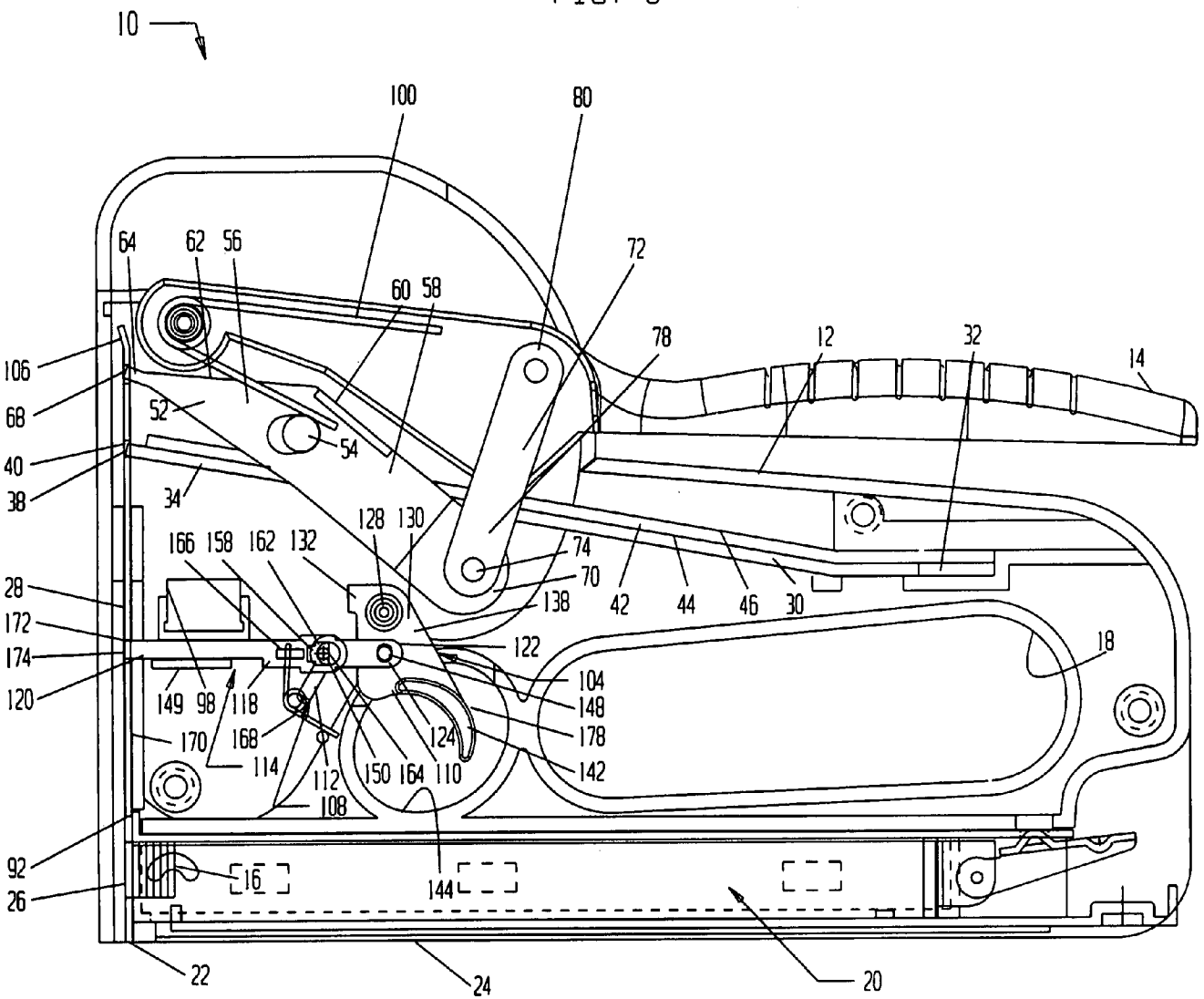
FIG. 8 is a side elevation of the stapler with the latch front tip having entered the striker opening and the lifter tip section about to disengage from the striker while in the second mode of operation.
Figure 9:
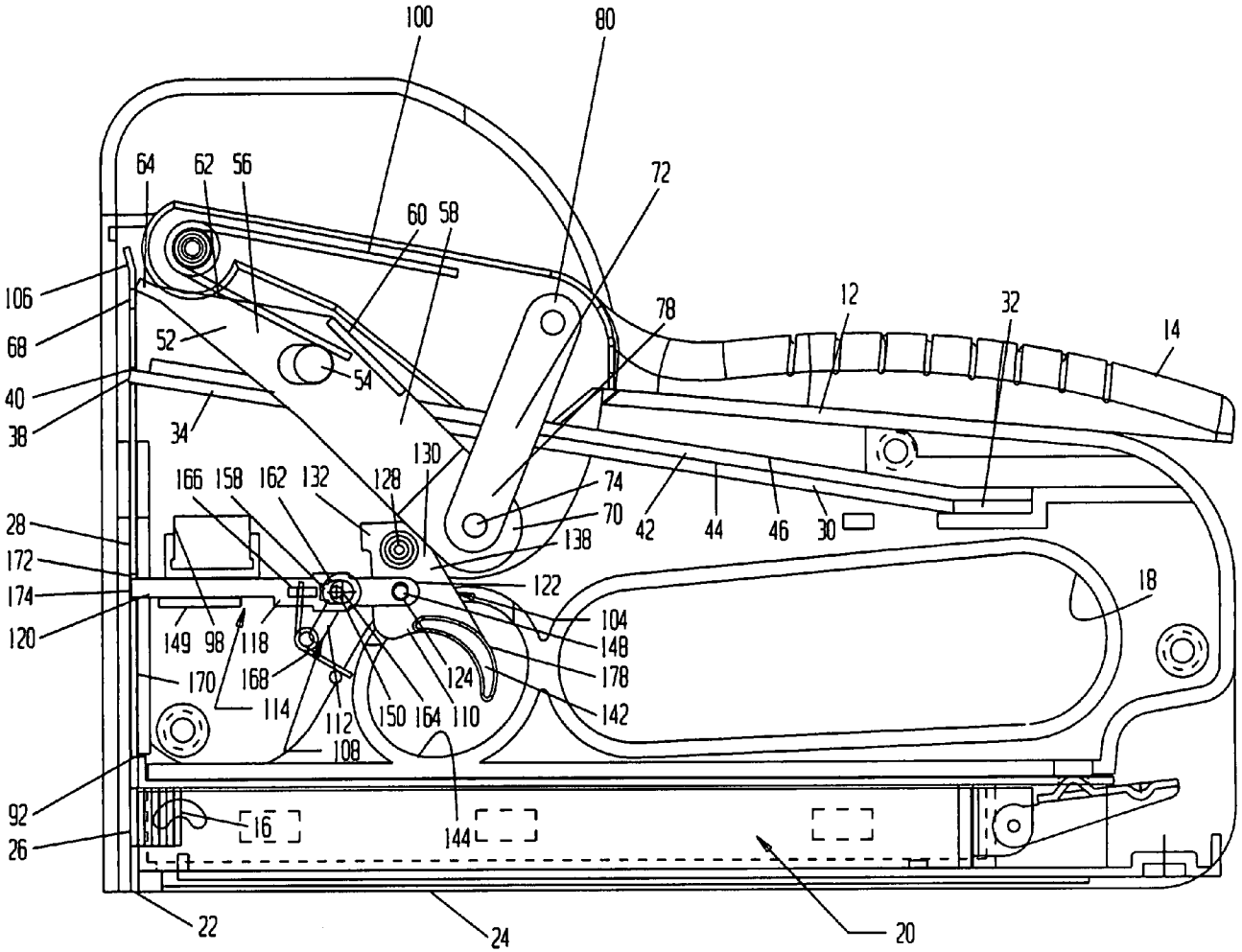
FIG. 9 is a side elevation of the stapler at the instant the lifter tip section becomes disengaged from the striker in the second mode of operation.
Figure 17:
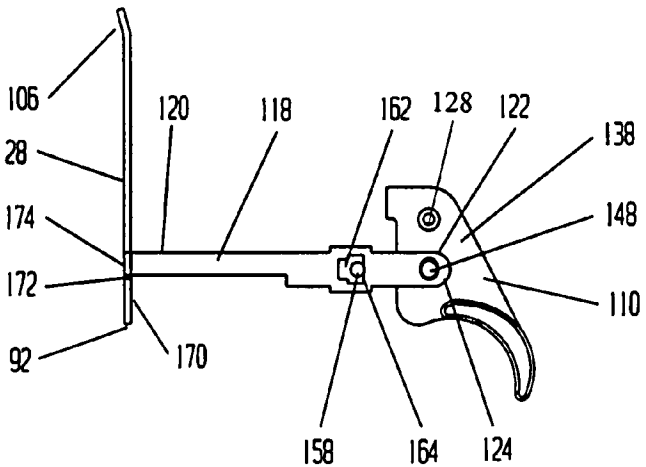
FIG. 17 is a side elevation showing the position of the latch and striker in the second mode of operation while the striker is restrained by the latch.

In FIG. 8, handle 14 has been partially depressed and striker 28 has been raised to a point where opening 172 in striker 28 is brought into alignment with latch 118. As opening 172 is moved into alignment with latch 118, latch 118 is advanced forward toward striker 28 by latch spring 168. Latch spring 168 pushes against a lug 166 on latch 118, to urge the front tip 174 of latch 118 forward into opening 172 in striker 28. As best seen in FIG. 17, once rear surface 164 of latch opening 162 contacts eccentric section 158, further forward movement of the latch tip 174 is restricted. With latch front tip 174 positioned within opening 168, the upward and downward movement of striker 28 is prevented. It is noted that in FIG. 8 lifter tips 64 of lifter 52 have been pivoted to a point where tips 64 are about to become fully disengaged from opening 68 in striker 28. As shown in FIG. 9, momentarily after latch 118 stops the upward travel of striker 28, the continued pivotable upward movement of front end 56 of lifter 52, caused by the continued downward movement of handle 14, completely withdraws lifter tip sections 64 from within lifter openings 68 in striker 28.

Figure 9A:
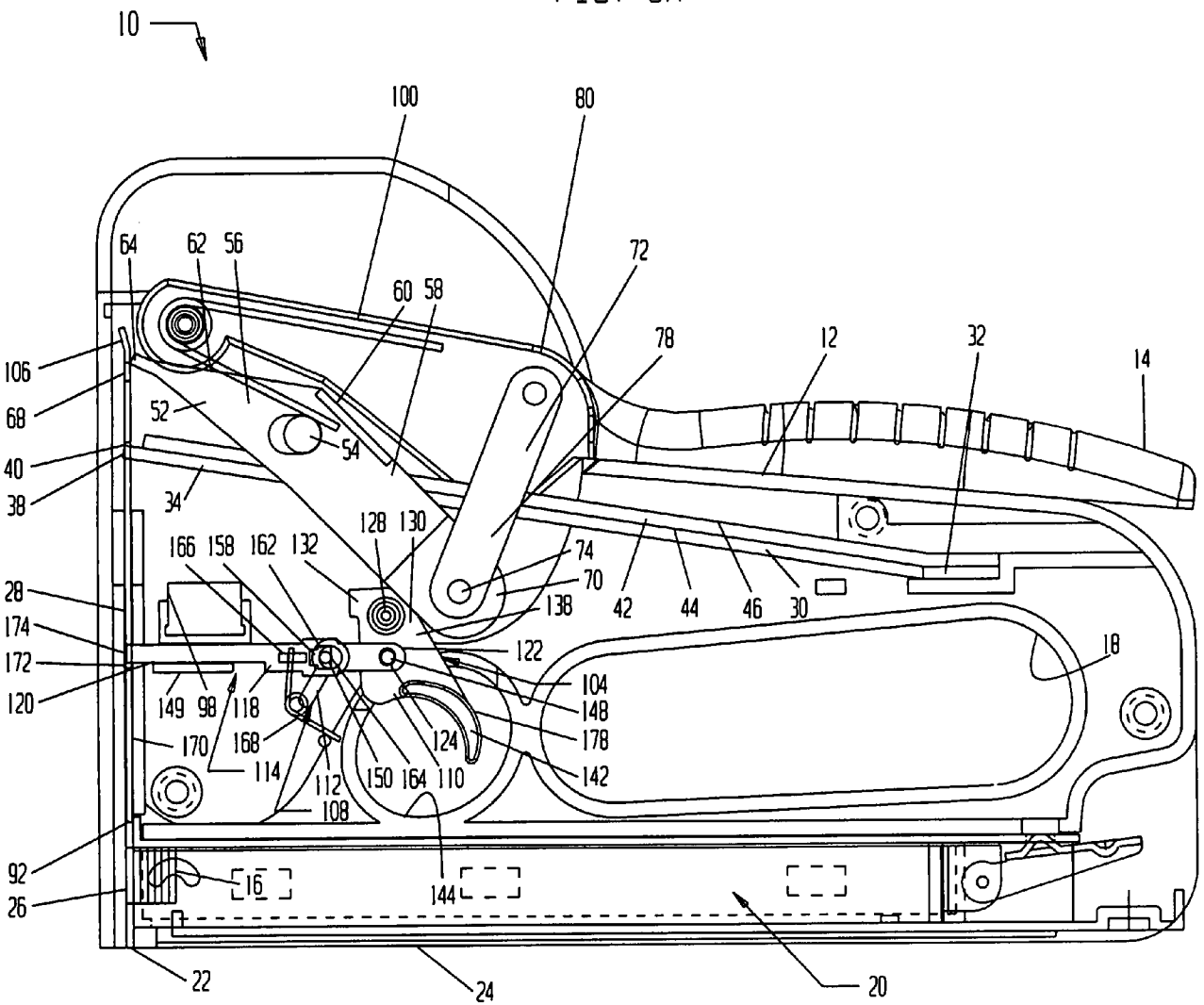
FIG. 9A is a side elevation of the stapler momentarily after being in the position shown in FIG. 9, showing the lifter tip section disengaged from the striker, and the latch restraining downward movement of the striker, the stapler is fully energized and the striker and spring are restrained in the cocked and loaded position while in the second mode of operation.

As best shown in FIGS. 9 and 9*a*, the height of striker opening 172 is greater than the height of latch front tip 174 providing clearance for latch front tip 174 to enter striker opening 172. This clearance also allows a sufficient window of time for latch tip 174 to enter striker hole 172 during the upward stroke of striker 28. FIG. 9 shows that latch tip 174 has fully entered hole 172 while there is clearance above tip 174. FIG. 9*a* shows striker 28 momentarily later than FIG. 9, when striker 28, after having been disengaged from lifter tip 64, has moved slightly downward and is now restrained from further downward movement by latch front tip 174 having entered striker opening 172. In FIG. 9A., the clearance is below latch front tip 174.

It is noted that in FIG. 9A, stapler 10 is in the cocked and loaded position with striker 28 cocked and springs 30, 42, fully loaded and cocked. Striker 28 and springs 30, 42 will next move when stapler 10 is fired. It is also noted that at this time trigger 110 is also cocked and ready to be fired. At this point, latch 118 is moved forward it greatest distance, and trigger 110 is pivoted forward so that the back surface 178 of trigger finger grip 142 is spaced its greatest distance from trigger opening 144 in housing 12.

It is noted for comparative purposes, that at a comparable point in the trigger off mode cycle, i.e. FIG. 3, striker 28 would immediately begin a downward stroke to fire stapler 10. However, at this stage of the cycle for the trigger on mode of operation, striker 28 remains restrained from downward movement by latch 118 and the stapling cycle is interrupted. The advantage of the trigger on mode of operation is that stapler 10 remains cocked and loaded until the user chooses to initiate the firing of stapler 10.

With stapler 10 cocked and loaded, the user may transport and position stapler 10 to any desired location prior to releasing trigger 110 to staple an object. This location may be an overhead or an otherwise inconvenient location. Thus, for example, a user of stapler 10 may cock stapler 10 in a convenient position of maximum leverage, such as at waist level. Later, the user may align an object at a desired location, which may be difficult to reach and then staple the object to the surface by pulling trigger 110.

Figure 10:
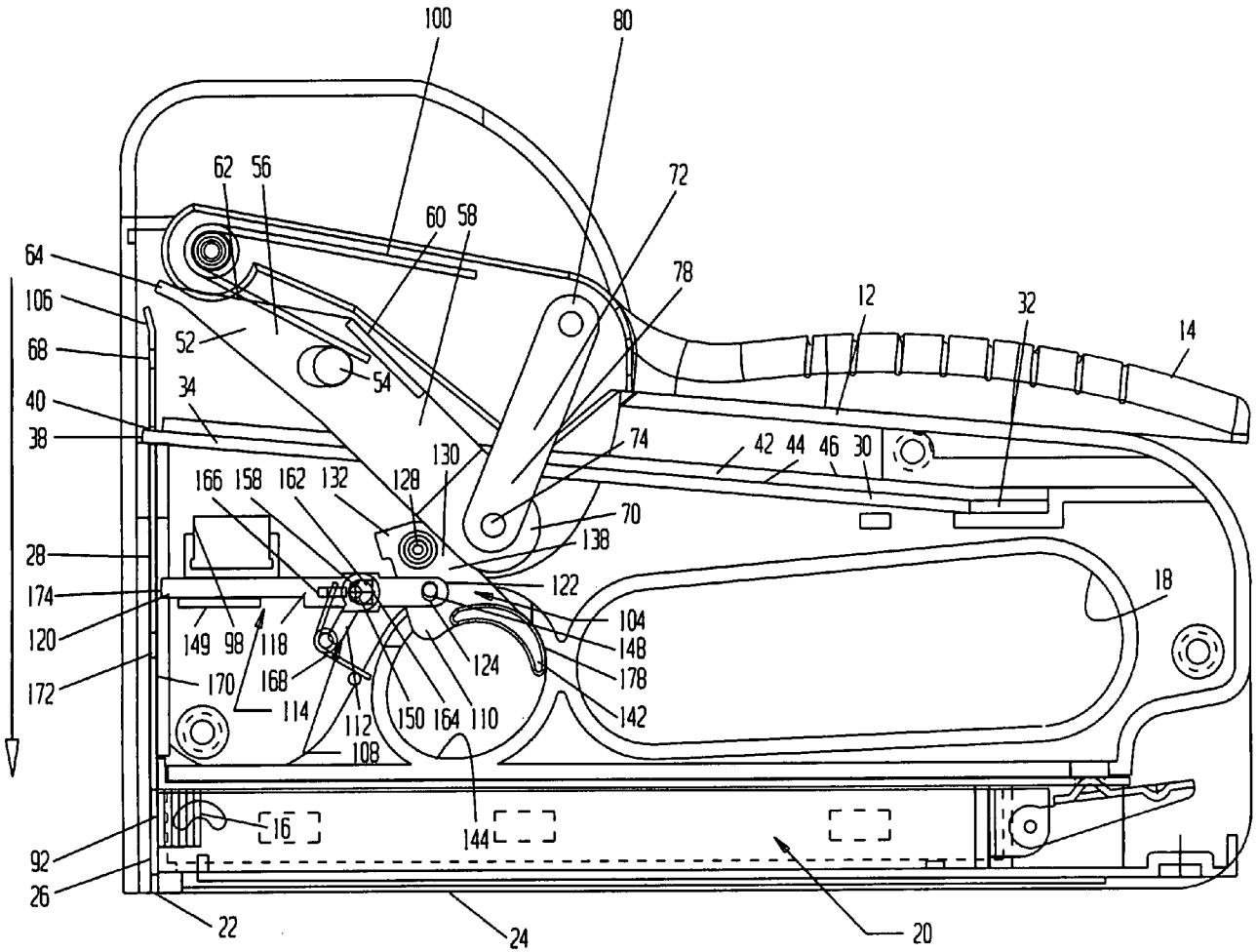
FIG. 10 is a side elevation of the stapler after firing the stapler and in its downward stroke in the second mode of operation.
Figure 18:
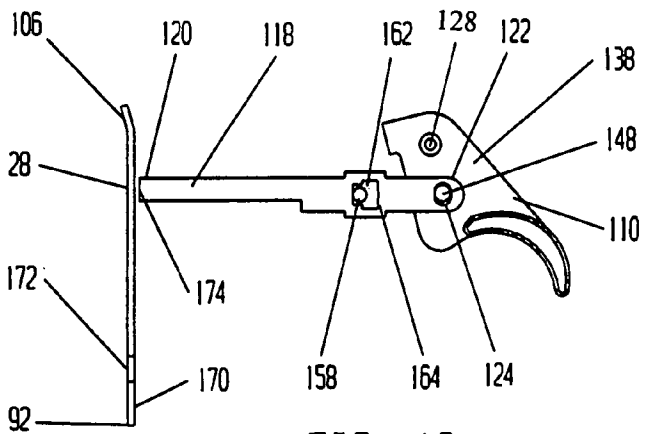
FIG. 18 is side elevation showing the position of the latch and striker in the second mode of operation after the trigger has been pulled to fire the stapler.

FIG. 10 shows stapler 10 having been fired and approximately at the midpoint of the downward stoke of striker 28. As best seen in FIG. 18, when trigger 110 is pulled to fire stapler 10, trigger 110, including trigger flange 130 rotates rearwardly at pin 128. As flange 130 moves rearward, flange pin 148 pulls latch 118 backward to disengage latch front tip 174 from engagement within opening 172 of striker 28. With front tip 174 disengaged and spaced from the back surface 170 of striker 28, the downward stoke of striker 28 is possible. The rapid downward stroke of striker 28, engages the lead staple 26 in staple feed mechanism 20 to staple an object as previously described.

Figure 11:
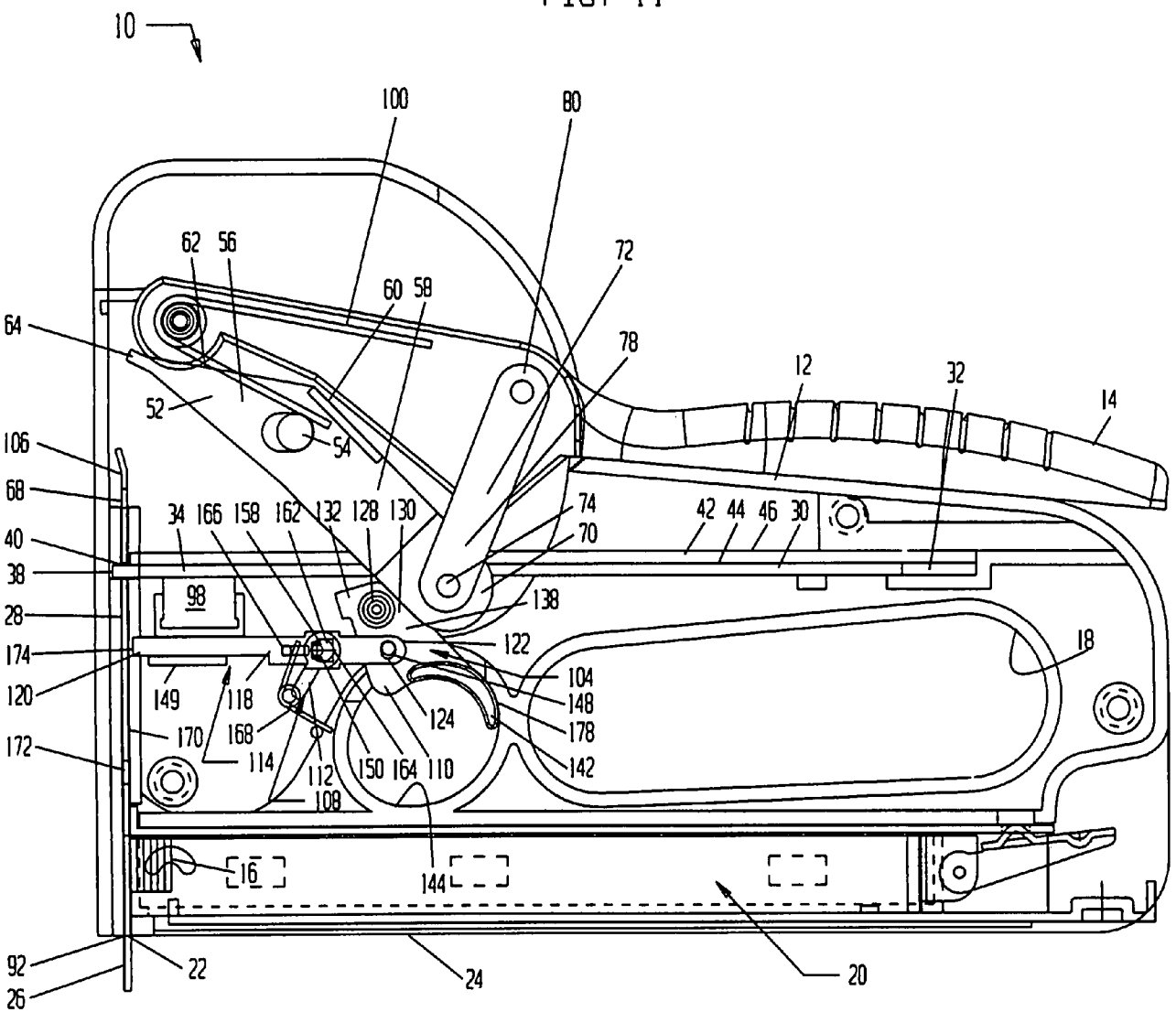
FIG. 11 is a side elevation of the stapler at the end of the stapling cycle and at the end of the downward stroke of the striker in the second mode of operation.

FIG. 11 shows the end of the downward stroke of striker 28 in the trigger on mode of operation. After stapling is accomplished, the user releases the grip on 14, and handle spring 100 returns handle 14 to the fully upward position shown in FIG. 6. Stapler 10 is then ready to repeat a stapling cycle. The stapling cycle for stapler 10 when operating in the second mode of operation, begins with stapler 10 in the position shown in FIG. 6. The stapling cycle includes the movements of stapler 10 as shown in FIGS. 6-11 and the movement to return stapler 10 back to the position of FIG. 6. The stapling cycle for the first mode of operation begins at FIG. 1, and continues through FIGS. 1-5, and the return of stapler 10 to the position of FIG. 1. The force applying, or energizing cycle of springs 30, 42, begins when springs 30, 42 are in the initial at rest position, and includes the position of maximum flexing or loading of spring 30, 42 during operation, and the return from the fully energized position to the initial at rest position. During a stapling cycle, striker 28 begins at the initial position of FIGS. 1 and FIG. 6, and moves through the upward stroke and the downward stroke to return to its initial position.

Thus, the second mode of operation allows stapler 10 to be cocked and loaded while held at any convenient position. In this mode, the stapler can be retained in the cocked and loaded state for an indefinite period of time while moving to any other location. Stapler 10 may then be aligned and fired to staple an article to a surface. Thus, it can be appreciated that the second mode of operation is particularly advantageous for installing staples at an overhead or awkward location, since stapler 10 can be cocked and loaded before moving the stapler into such awkward position. Stapler 10 may include a safety (not shown) that can be engaged after cocking stapler 10, so that accidental discharge of stapler 10 is prevented, such as when transporting from between locations.

The second mode of operation is also advantageous for precision stapling, such as required in upholstering applications. A cocked and loaded stapler 10 can be moved in place over a pre-aligned fabric and furniture frame. Stapler 10 is then aligned and fired. Thus, a critical alignment is not disturbed by the torque created by the user during handle depression to load the springs 30, 42, since the handle 14 was depressed at another location.

In the second mode of operation, handle 14 also can be more conveniently depressed by using two hands. Additionally, handle 14 may also be depressed by placing stapler 12 on a flat surface, such as a bench, and using body weight to aid in depressing handle 14 against the force of springs 30, 42. After cocking and loading stapler 12 at the bench or other flat surface, the stapler can be taken to the location where the stapler will be used to staple an object.

Figure 19:
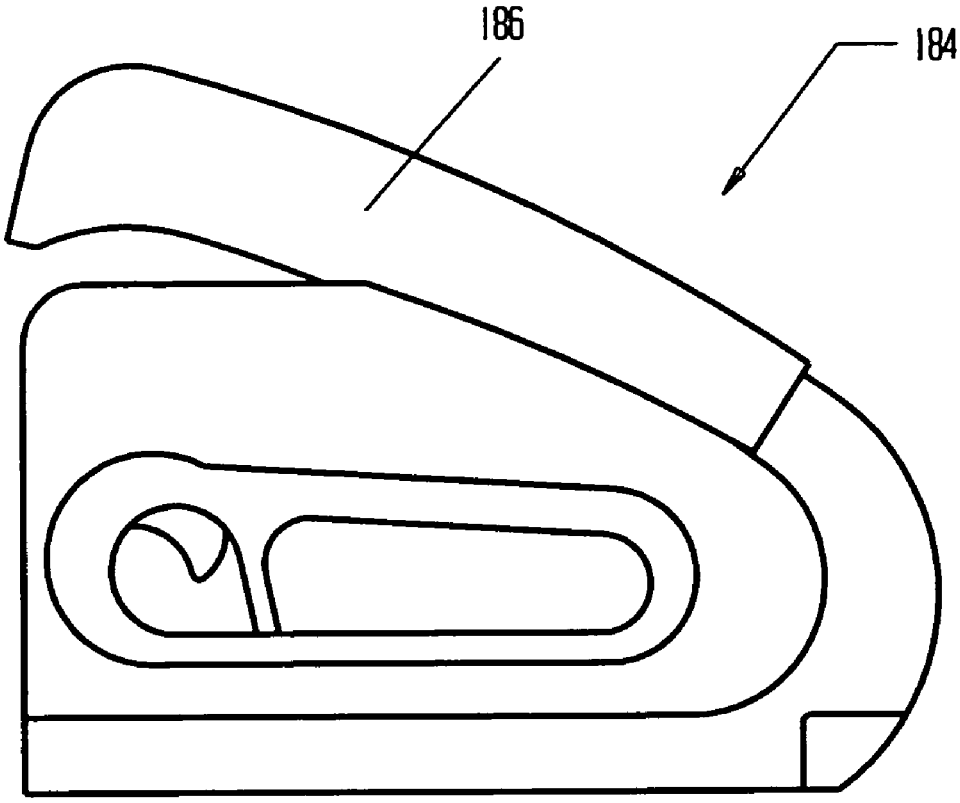
FIG. 19 shows a second embodiment of the invention having a forward facing handle.

While stapler 10 has been described in connection with a rearward facing handle, as shown in FIG. 19, a stapler 184 utilizing features of the invention may also be adapted for use with a forward facing handle 186. It is also noted that stapler 10 could also be adapted for use with a push button activator, or another type of activator, rather than the trigger arrangement shown and described. Also, while stapler 10 has been described with a cycle interrupter, such as latch 118 cooperating with striker 28 to interrupt the stapling cycle, the cycle interrupter could cooperate with other structures of stapler 10 to interrupt the stapling cycle. For example, a cycle interrupter could engage the spring when the spring is in the cocked and loaded position, with later disengagement from the spring to allow the stapler to fire.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

The invention claimed is:

1. A staple gun comprising:

a striker, the striker moveable through a stapling cycle that includes a cocked position prior to the striker striking a staple to apply a staple;

a force providing mechanism movable through an energizing cycle that includes a cocked position, the force providing mechanism including manually operable handle, the handle operatively connected to a lifter that is moveable from a position engaging the striker to a position disengaged from the striker, the lifter being in the position engaging the striker to move the striker to the cocked position in response to manual movement of the handle to provide a force to the striker for striking a staple to apply a staple, the lifter configured to move to the position disengaged from the striker in response to continued manual movement of the handle;

a cycle interrupter configured to engage the striker to prohibit movement of the striker and to interrupt the stapling cycle when the striker is in the cocked position or when the force providing mechanism is in the cocked position;

an actuator mechanism configured to disengage the cycle interrupter to thereby allow the stapling cycle to continue so that the striker may strike a staple;

wherein the actuator mechanism includes an actuator member configured to be manually moved to cause the actuator mechanism to disengage the cycle interrupter; and a mode selection control for selecting between a first mode of operation and a second mode of operation, the first mode of operation allowing the cycle interrupter to be active, and the second mode of operation deactivating the cycle interrupter so that the cycle interrupter does not automatically interrupt a cycle.

2. The staple gun of claim 1 wherein the force providing mechanism further includes a spring, and the cycle interrupter includes a latch, the latch having a first end and a second end, the first end of the latch movable from a disengaged position that does not engage the striker to prohibit movement of the striker, to an engaged position that engages the striker to interrupt the stapling cycle, the first end of the latch being automatically moveable to the engaged position to interrupt the stapling cycle when the striker is in the cocked position and when the staple gun operates in the first mode of operation, the second end of the latch being operatively connected to the actuator mechanism, and when operating in the first mode of operation, movement of the actuator mechanism causes the first end of the latch to move from the engaged position to allow the stapling cycle to continue.

3. A stapler device comprising:

a striker, the striker reciprocally moveable between at least a first position and a second position;

at least a first spring, the spring moveable between at least a first position to a second position for storing energy in the spring, the spring being operatively engaged to the striker to cause rapid movement of the striker when the striker is released from the second position;

a loading mechanism for moving the striker from at least the first position to the second position;

a striker movement inhibitor that is moveable between a disengaged position where the striker movement inhibitor is disengaged from the striker and allows movement of the striker, and an engaged position where the striker movement inhibitor is engaged to the striker and restrains movement of the striker, the striker movement inhibitor moveable from the disengaged position to the engaged position when the striker is in the second position to maintain the striker in the second position; and an actuator mechanism for disengaging the striker movement inhibitor from the engaged position to thereby allow the striker to move from the second position, whereby the first spring may rapidly move the striker to the first position wherein the stapler includes a mode selection mechanism selectively movable from an operative mode, wherein the striker movement inhibitor is permitted to move to the engaged position to engage the striker and maintain the striker in the second position, to an inoperative mode, wherein the mode selection mechanism automatically engages the striker movement inhibitor to prevent the striker movement inhibitor from moving to the engaged position.

4. The stapler device of claim 3 wherein the striker movement inhibitor automatically moves to the engaged position when the striker is moved to the second position, and the actuator mechanism is manually actuated to cause the striker movement inhibitor to move to the disengaged position to allow the striker to be released from the second position and to allow the first spring to be released from the second position.

5. The stapler device of claim 3 wherein the loading mechanism includes a handle and the handle is operatively engaged to the striker to move the striker to the second position and the first spring to the second position when the handle is manually moved.

6. The stapler device of claim 3 wherein the actuator mechanism includes a trigger operatively connected to the striker movement inhibitor, the trigger having a ready position allowing the striker movement inhibitor to maintain the spring and the striker in the second position, and the trigger is manually moveable to a fired position to cause the striker movement inhibitor to move to the disengaged position to release the spring and the striker from the second position.

7. The stapler device of claim 6 wherein the striker movement inhibitor includes a latch, the latch having first end and a second end, the latch being movable between an engaged position and a disengaged position, the first end of the latch engaging the striker when the latch is in the engaged position to maintain the striker in the second position.

8. The stapler device of claim 7 wherein the second end of the latch is connected to the actuator mechanism, and movement of the trigger to the fired position causes movement of the latch to the disengaged position, whereby the latch is disengaged from the striker.

9. The stapler device of claim 8 wherein the striker movement inhibitor includes a latch spring, the latch spring normally biasing the latch towards the striker, and movement of the trigger to the fired position moves the latch away from the striker to allow the striker to be rapidly moved from the second position to the first position by the force of the first spring.

10. The stapler device of claim 9 wherein the striker has a first surface, the first surface including an opening, and the first end of the latch is normally biased by the latch spring toward the first surface of the striker, the first end of the latch being moved into engagement with the opening by the latch spring when the striker is moved to the second position to maintain the striker in the second position until the trigger is moved into the fired position.

11. The stapler device of claim 10 wherein the first spring is attached to the striker.

12. The stapler device of claim 6 further characterized by a housing, the trigger being pivotably mounted to the housing, and the trigger has a first end operatively connected to the striker movement inhibitor, whereby the trigger can be pivoted to cause the striker movement inhibitor to move to the disengaged position.

13. The staple device of claim 3 wherein the loading mechanism includes a manually operable lever and a lifter, the lifter having one end operatively connected to the lever and a second end that is moveable from a position engaging the striker to a position disengaged from the striker, the lifter being in the position engaging the striker to move the striker and the first spring to the second position in response to manual movement of the lever, the striker movement inhibitor moving to the engaged position to engage the striker to restrain the striker when the striker is moved to the second position, and the lifter configured to move to the position disengage from the striker in response to continued manual movement of the lever while the striker movement inhibitor continues to restrain the striker.

14. The stapler device of claim 3 wherein the mode selection mechanism includes a locking pin, the locking pin having a first section and a second section, the second section being eccentric relative to the first section, the second section engaging the striker movement inhibitor to prevent advancement of the striker movement inhibitor to engage the striker when the mode selection mechanism is in first position, and the second section allowing engagement of the striker movement inhibitor with the striker when the mode selection mechanism is in the second position.

* * * * *